US007028589B1

(12) United States Patent
Cheng

(10) Patent No.: US 7,028,589 B1
(45) Date of Patent: Apr. 18, 2006

(54) RESILIENT POSITIONING ASSEMBLY FOR AN AXLE IN A POWER TOOL

(76) Inventor: Ming-Ta Cheng, No. 38-11, Lin 10, Zhongzheng Li, Yuanli Chen, Miaoli Hsien (TW)

( * ) Notice: Subject to any disclaimer, the term of this patent is extended or adjusted under 35 U.S.C. 154(b) by 0 days.

(21) Appl. No.: 11/168,307

(22) Filed: Jun. 29, 2005

(51) Int. Cl.
*B25B 13/04* (2006.01)

(52) U.S. Cl. ..... 81/177.85; 81/125; 81/177.2; 81/438

(58) Field of Classification Search ..... 81/125, 81/177.2, 177.85, 438, 439
See application file for complete search history.

(56) References Cited

U.S. PATENT DOCUMENTS 4,844,177 A * 7/1989 Robinson et al. ..... 173/178
5,640,889 A * 6/1997 Anderson ..... 81/125
6,076,436 A * 6/2000 Farley ..... 81/177.85
6,925,910 B1 * 8/2005 Alford ..... 81/57.29

* cited by examiner

*Primary Examiner*—Lee D. Wilson
*Assistant Examiner*—Anthony Ojini
(74) *Attorney, Agent, or Firm*—Bacon & Thomas, PLLC

(57) ABSTRACT

A power tool includes an annular recess adapted to be defined in the peripheral edge to receive therein a resilient loop, a slot adapted to be defined in a side face of the peripheral edge and a hole defined in a side face defining the slot to communicate with the annular recess so as to movably receive therein a ball such that engagement between the resilient loop and a first auxiliary tool mounted outside the driving end is secured because of engagement of the resilient loop to an inner face of the auxiliary tool.

5 Claims, 5 Drawing Sheets

RESILIENT POSITIONING ASSEMBLY FOR AN AXLE IN A POWER TOOL

BACKGROUND OF THE INVENTION

1. Field of the Invention

The present invention relates to a resilient positioning assembly, and more particularly to a resilient positioning assembly for an axle in a power tool so that the axle is able to adapt to different tools for application.

2. Description of Related Art

A power tool is normally required to be adaptable to for connection with different tools for different purposes. For example, a power tool may be adapted to connect with a socket to tighten or loosen nuts or a power tool may be adapted to connect with a screwdriver to screw or unscrew a screw. With reference to FIG. 4, a conventional positioning assembly (50) in a power tool (60) is shown and has a connection end (51) to connect with an auxiliary tool (not shown), a driving end (52) integrally formed with the connection end (51) to connect to the power tool body, a hexagonal slot (53) defined in a distal end of the connection end (51), a magnetic element (54) received in a bottom face defined in the hexagonal slot (53) and a C clip (55) sandwiched between the connection end (51) and the driving end (52) to secure engagement between the connection end (51) and the driving end (52). Therefore, a hexagonal shaft (61) extending from the auxiliary tool (60) can extend into the hexagonal slot (53) to be driven by the power tool. However, because the positioning force on the hexagonal shaft (61) to maintain the hexagonal shaft (61) inside the hexagonal slot (53) depends solely on the magnetic element (54), it is not sufficient to secure the hexagonal shaft (61), especially when the movement of the hexagonal shaft (61) is violent.

In order to solve the problem of insufficient positioning force to the tool shaft, a different positioning assembly in a power tool is introduced and shown in FIG. 5. The power tool has an axle (70) provided with a slot (71) and steel ball (72) received in a side face of the axle and extending into the slot (71). Therefore, after a tool shaft (73) having a positioning recess (74) defined in a side face of the tool shaft (73) is inserted into the slot (71) to allow the steel ball (72) to be rested in the positioning recess (74), the tool shaft (73) is positioned inside the slot (71). Still, this structure uses friction between two metal surfaces, which causes wear to both the tool shaft (73) and the axle (70). As a result, engagement between the axle (70) and the tool shaft (73) is loosed and sometimes may even cause damage to users or bystanders.

To overcome the shortcomings, the present invention tends to provide an improved resilient positioning assembly to mitigate the aforementioned problems.

SUMMARY OF THE INVENTION

The primary objective of the present invention is to provide a resilient positioning assembly for an axle of a power tool and has a resilient loop received in an annular recess defined in a peripheral edge of the driving end of the power tool and a ball movably received in a hole in communication with the annular recess so that when the driving end is inserted into an auxiliary tool, the resilient loop is able to help secure the auxiliary tool and when the auxiliary tool is inserted into a slot defined in a side face of the driving end, the ball is able to be rested in a corresponding recess in the auxiliary tool.

In one aspect of the present invention, the driving end is rectangular.

In yet another aspect of the present invention, the slot for receiving therein the auxiliary tool is hexagonal.

A further aspect of the present invention is that the resilient loop has a height in cross section, which is larger than a depth of the annular recess so that when the driving end is inserted into the auxiliary tool, the resilient tool is able to help secure the auxiliary tool.

Other objects, advantages and novel features of the invention will become more apparent from the following detailed description when taken in conjunction with the accompanying drawings.

DETAILED DESCRIPTION OF THE PREFERRED EMBODIMENT

Figure 1:
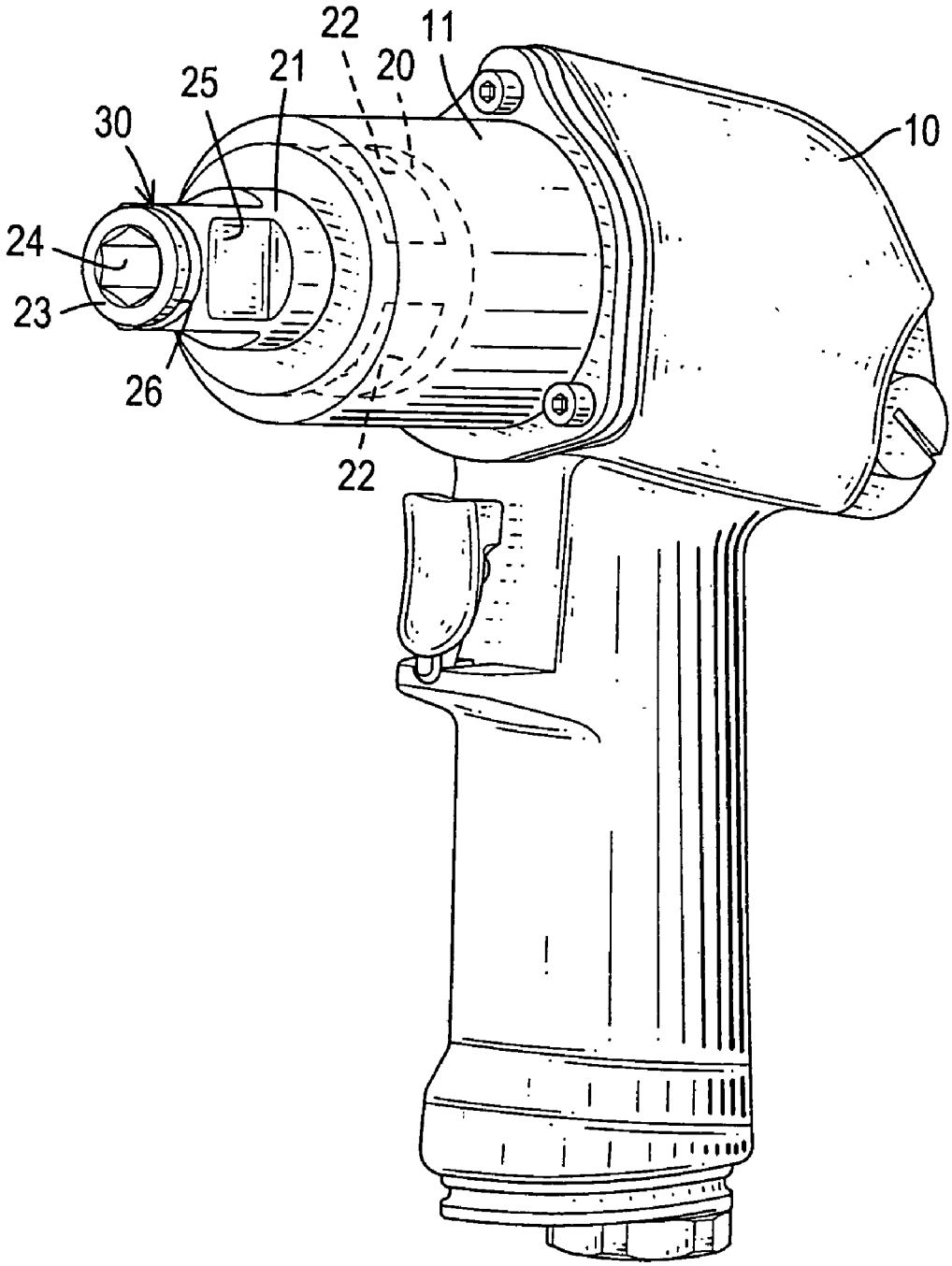
FIG. 1 is a perspective view of the positioning assembly in a power tool.

With reference to FIG. 1, it is noted that a power tool body (10) has an extension (11) extending from a side of the power tool body (10) and an axle extending from a side face of the extension (11). The axle is divided into a fixing portion (20) having a first diameter and multiple mutual corresponding recessed areas (22) defined around an outer surface of the fixing portion and a connection portion (21) having a second diameter smaller than that of the first diameter of the fixing portion (20). Furthermore, the connection portion (21) is divided into a driving end (25) and a peripheral edge (23) formed on a distal edge of the driving end (25) and having a slot (24) defined in the peripheral edge (23). Preferably, the driving end (25) is rectangular and the slot (24) is hexagonal.

Figure 2:
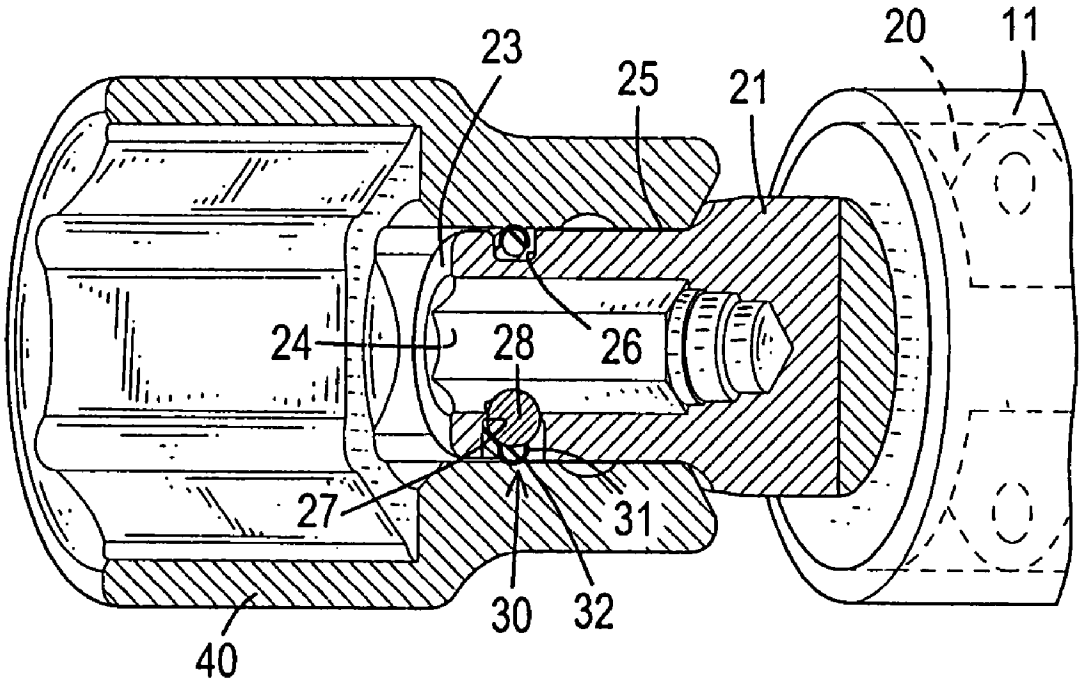
FIG. 2 is a schematic cross sectional view showing that the driving end of the power tool is inserted into an auxiliary tool.

With reference to FIG. 2, it is noted that a positioning hole (27) is defined in a side face defining the slot (24) to communicate with an annular recess (26) defined around the peripheral edge (23) such that a ball (28) is able to be securely received in the positioning hole (27) and a resilient loop (30) consisting of an O ring (31) and a resilient C shaped cap (32) mounted around the O ring (31) is able to be received in the annular recess (26).

With reference to FIG. 2, it is noted that when a socket (40) is to be connected to the driving end (25), the driving end (25) is inserted into the socket (40). Because the resilient loop (30) has a cross sectional height larger than a depth of the annular recess (26), a portion of the resilient loop (30) is exposed the annular recess (26) such that after the driving end (25) is inserted into the socket (40), the exposed resilient loop (30) outside the annular recess (26) is able to secure engagement between the socket (40) and the driving end (25).

Figure 3:
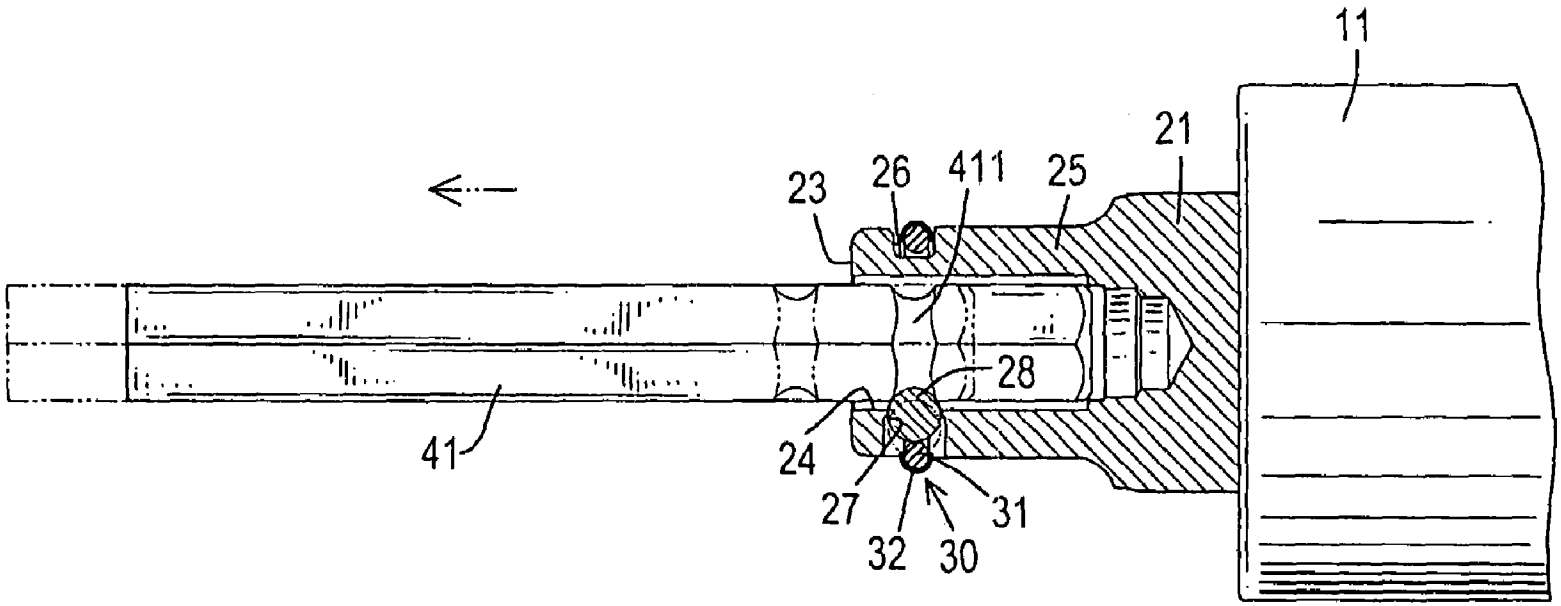
FIG. 3 is a schematic cross sectional view showing that the auxiliary tool is inserted into the slot of the driving end to be secured by the positioning assembly of the present invention.
Figure 4:
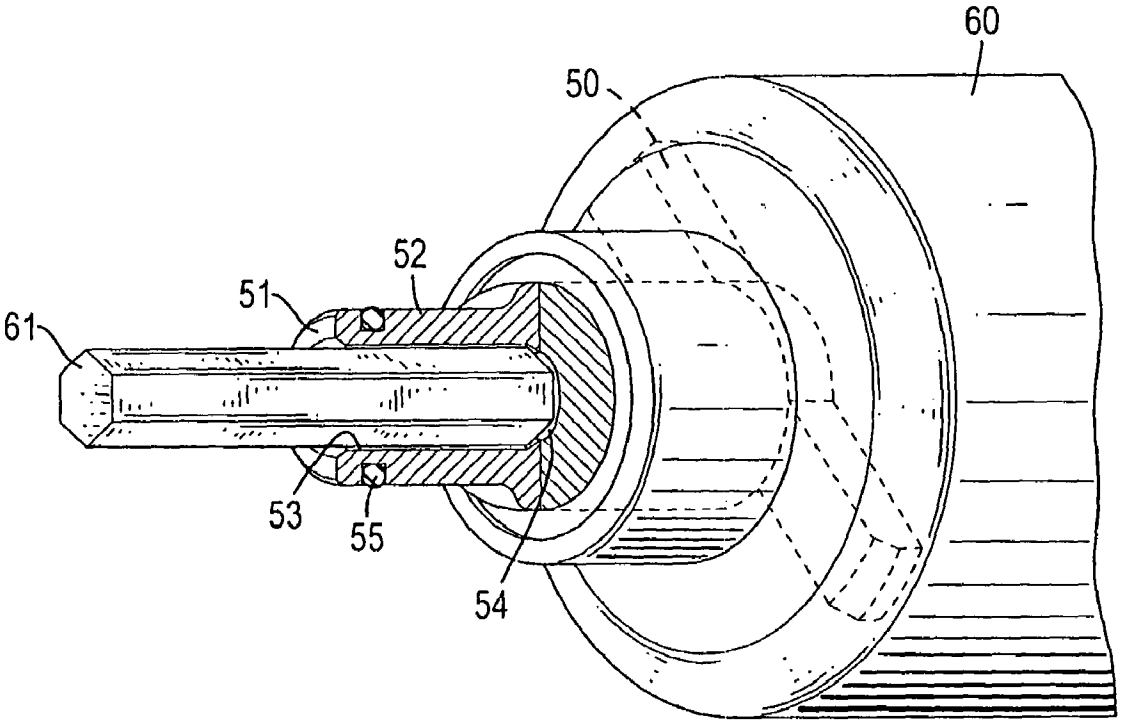
FIG.4 PRIOR ART
FIG. 4 is a schematic view in partial section showing a conventional positioning assembly in a power tool.
Figure 5:
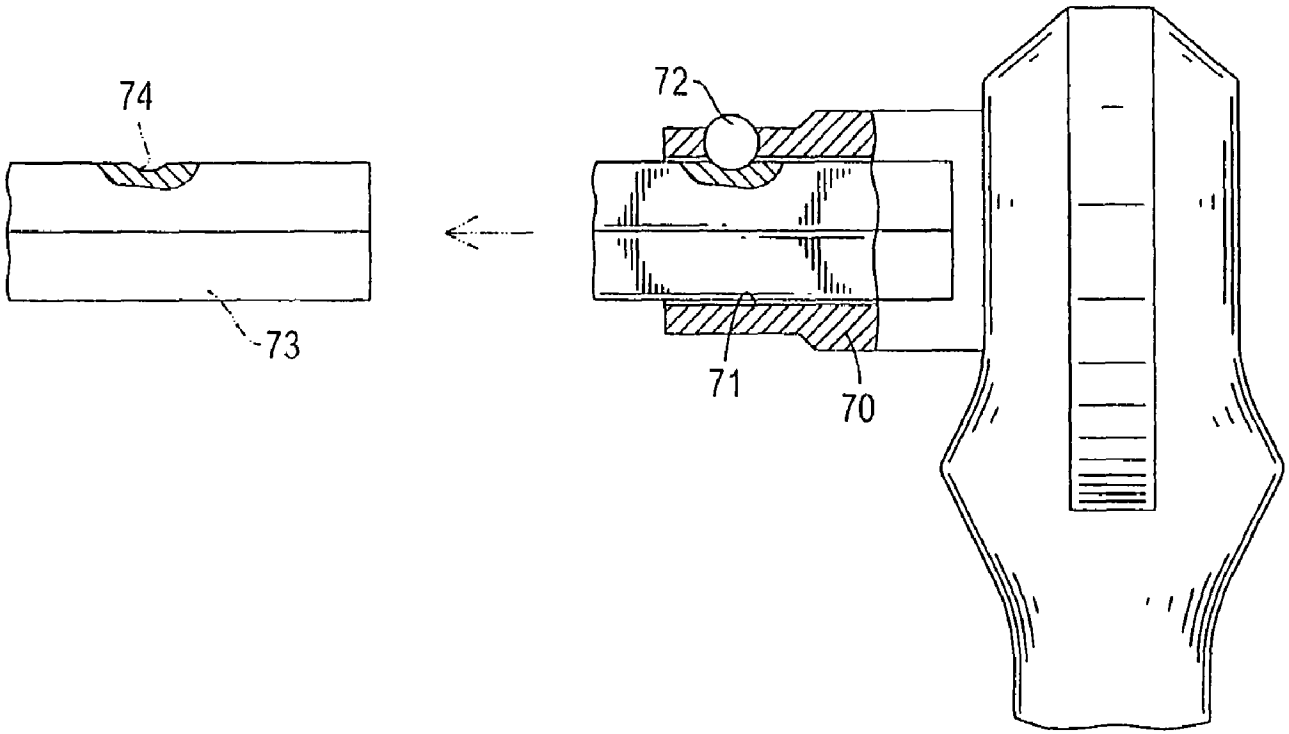
FIG.5 PRIOR ART
FIG. 5 is a schematic view in partial section showing a different positioning assembly in a power tool.

Further, with reference to FIG. 3, after a different auxiliary tool such as a screwdriver (41) having continuously defined securing recesses (411) is to be connected to the driving end (25), the screwdriver (41) is inserted into the slot (24) to allow the ball (28) to be rested in a corresponding one of the securing recesses (411). However, before the ball (28) is received in the securing recess (411), the extension of the screwdriver (41) forces the ball (28) to move inside the positioning hole (27) so as to allow the screwdriver (41) to be extended into the slot (24) smoothly. That is, the ball (28) is first forced to move toward the resilient loop (30) and then after the ball (28) corresponds to the corresponding one of the securing recesses (411), the ball (28) is moved back to be received in the corresponding securing recess (411) due to the resilience from the resilient loop (30).

From the above description, it is noted that the resilient loop (30) does have far more better positioning function to the auxiliary tool to be connected to the power tool when compared to the conventional positioning assembly, because there is no worry about wear caused by friction between the driving end (25) and the auxiliary tool.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A power tool having a body, an extension extending from a side of the body and an axle extending from a side of the extension and divided into a fixing portion having a first diameter and a connection portion having a second diameter smaller than the first diameter, the connection portion being divided into a driving end and a peripheral edge formed on a distal edge of the driving end, wherein:

an annular recess is defined in the peripheral edge to receive therein a resilient loop having a diameter such that while the resilient loop is received in the annular recess, a portion of the resilient loop protrudes outward from the annular recess;

a slot is defined in a side face defining the peripheral edge; and a hole is defined in communication between the slot and the annular recess so as to movably receive therein a ball such that engagement between the resilient loop and a first auxiliary tool mounted outside the driving end may be secured by engagement of the resilient loop to an inner face of the first auxiliary tool and engagement between the ball and a second auxiliary tool extendable into the slot may be secured by engagement of the ball to an outer periphery of the second auxiliary tool.

2. The power tool as claimed in claim 1, wherein the slot is hexagonal.

3. The power tool as claimed in claim 1, wherein the slot is hexagonal.

4. The power tool as claimed in claim 1, wherein the driving end is rectangular.

5. The power tool as claimed in claim 1, wherein the driving end is rectangular.

* * * * *